US006914375B2

(12) United States Patent
Lee

(10) Patent No.: US 6,914,375 B2
(45) Date of Patent: Jul. 5, 2005

(54) DYNAMIC VIBRATION ABSORBER IN CATHODE RAY TUBE

(75) Inventor: Ho Jun Lee, Masan-shi (KR)

(73) Assignee: LG. Philips Displays Korea Co., Ltd., Kyongsangbuk-do (KR)

( * ) Notice: Subject to any disclaimer, the term of this patent is extended or adjusted under 35 U.S.C. 154(b) by 55 days.

(21) Appl. No.: 10/158,868

(22) Filed: Jun. 3, 2002

(65) Prior Publication Data

US 2003/0048060 A1 Mar. 13, 2003

(30) Foreign Application Priority Data

Aug. 29, 2001 (KR) ..... P2001-52569

(51) Int. Cl.[7] ..... H01J 29/80; H01J 29/81
(52) U.S. Cl. ..... 313/402; 313/407; 313/269
(58) Field of Search ..... 313/402, 407, 313/408, 269, 219, 404, 403, 405, 313, 479

(56) References Cited

U.S. PATENT DOCUMENTS 4,506,188 A * 3/1985 Puhak ..... 313/405
4,827,179 A * 5/1989 Adler et al. ..... 313/402
5,382,871 A 1/1995 Funahashi et al. ..... 313/402
5,550,335 A 8/1996 Ermert et al. ..... 181/207
6,469,429 B1 * 10/2002 Berton ..... 313/402

FOREIGN PATENT DOCUMENTS

| | | |
|---|---|---|
| EP | 0 984 482 A2 | 3/2000 |
| EP | 1 087 418 A1 | 3/2000 |
| WO | WO 02/09138 A1 | 1/2000 |
| WO | WO 02/39477 A2 | 5/2000 |

* cited by examiner

*Primary Examiner*—Don Wong
*Assistant Examiner*—Chuc Tran
(74) *Attorney, Agent, or Firm*—Birch, Stewart, Kolasch & Birch, LLP

(57) ABSTRACT

Dynamic vibration absorber in a CRT having a shadow mask fastened to an inside surface of a panel by main frames, including a base part to be fitted to a non-effective surface of the shadow mask, and a vibration absorbing part having one end connected to the base part and the other end designed to make no contact with the shadow mask and the main frame, thereby attenuating vibration of the shadow mask.

11 Claims, 11 Drawing Sheets

161Hz

164Hz

166Hz

168Hz

169Hz

170Hz

175Hz

182Hz

190Hz

199Hz

208Hz

DYNAMIC VIBRATION ABSORBER IN CATHODE RAY TUBE

This application claims the benefit of the Korean Application No. P2001-52569 filed on Aug. 29, 2001, which is hereby incorporated by reference.

BACKGROUND OF THE INVENTION

1. Field of the Invention

The present invention relates to a cathode ray tube (CRT), and more particularly, to a dynamic vibration absorber in a cathode ray tube, which can attenuate a vibration of a shadow mask caused by an external impact effectively, and is of a type that exhibits almost no variation of a natural frequency for a variation of a temperature.

2. Background of the Related Art

A structure of a related art CRT will be explained, with reference to FIG. 1.

At a rear end of a panel 1 having a R, G, B fluorescent film coated thereon, there is a funnel 2 having an electron gun sealed therein for emitting an electron gun 6 welded thereto. There is a shadow mask 3 fitted to an inside surface of the panel 1 having a plurality of slots for passing the electron beam, and there are a deflection yoke 5 and a magnet 10 fitted to an outside surface of the funnel 2. Also, there is a reinforcing band 11 on an outside surface of the panel 1 for preventing breakage of the CRT from an external impact.

The shadow mask 3 is fitted to have a gap to the inside surface of the panel 1 by a main frame, and the main frame 7 is fastened to the panel 1 by springs 8. Also, there is an inner shield 9 fitted the main frame 7 for shielding the CRT from an external geomagnetism so that the CRT is affected less by the geomagnetism.

Referring to FIGS. 2 and 3, a shadow mask assembly will be explained.

The shadow mask 3 is welded to one pair of main frames 7 under tension. The shadow mask 3 is liable to vibrate by an external vibration, such as from a speaker. The vibration causes a color error in forming a picture by means of the electron beam, to deteriorate the picture. Therefore, a vibration absorber is provided to the shadow mask 3 for absorbing the vibration on the shadow mask 3. In detail, there are sub-frames 12 between the one pair of the main frames 7, and there are damper springs 14 fitted to the sub-frame 12, and there is a damper wire 13 between the damper springs 14. When a tension is applied to the damper wire 13 by using the damper spring 14, the damper wire 13 is pressed onto the shadow mask 3, to prevent vibration of the shadow mask 3. There are about three lines of the damper wires 13, for prevention of vibration.

However, the related art vibration absorber of the damper wire has the following problems.

Since the damper wire 13 has a very thin diameter of approx. 30 $\mu$m, the damper wire is highly susceptible to breakage during fabrication of the CRT. Also, there are cases when the damper wire 13 is broken during use after the CRT is sold to the user. Because an inner space of the CRT is under vacuum, the broken damper wire moves therein, to show a shadow of the broken damper wire on the screen forming a defective picture, of which repair is impossible. Moreover, the expensive precision apparatus for handling the fine damper wire is a factor that makes the production cost high.

In order to solve the foregoing problems, a dynamic vibration absorber may be utilized. A principle of the dynamic vibration absorber will be explained, with reference to FIGS. 4 and 5. FIG. 4 illustrates an example a dynamic vibration absorber is applied to a one degree of freedom system.

An object system 1 S1, of which vibration is intended to be reduced can be represented with a mass m1 and a spring constant k1. When an external force exciting a vibration at a frequency w is applied to the system 1 S1, a vibration with a frequency w occurs at the system 1 S1. For attenuating the vibration of the system 1 S1, a system 2 S2 having a natural frequency w is provided to the system 1 S1. The system 2 S2 may also be represented with a mass m2 and spring constant k2. In this system, the vibration of the system 1 S1 is transmitted to the system 2 S2, such that, not the system 1 S1, but the system 2 S2, vibrates. Accordingly, an effect of reducing the vibration of the system 1 S1 can be obtained. The system 2 S2 provided to reduce the vibration is called as a dynamic vibration absorber.

With regard to the dynamic vibration absorber, it is important how much well the natural frequency of the system 2 S2 is tuned to the excited frequency. If the excited frequency and the system 2 S2 are not well tuned, there is no vibration attenuation effect at all, and, contrary to this, the natural frequency of the system 1 S1 is increased.

For correcting the foregoing disadvantage of the dynamic vibration absorber, damping means, i.e., a damper c2 may be added to the system 2 S2. An appropriately designed damper c2 fitted to the system 2 S2 can provide a vibration attenuation effect even if the tuned slightly inaccurately.

FIGS. 6 and 7A–7D illustrate perspective views each showing a dynamic vibration absorber disclosed in U.S. Pat. No. 4,827,179, wherein a dynamic vibration absorber of a system with one degree of freedom is applied to a shadow mask of a system with multiple degrees of freedom. The U.S. Pat. No. 4,827,179 discloses multiple dynamic vibration absorber applied to a shadow mask that has a natural frequency varied with a temperature of a screen during operation of the CRT, and designed only to attenuate a first order vibration of the shadow mask.

FIG. 6 illustrates a dynamic vibration damper without a damper. The related art dynamic vibration absorber has a problem in that, though attenuation of vibration is good at a certain temperature owing to good tuning, the attenuation of vibration becomes poor sharply due to no provision of a cantilever matched to the first order of natural vibration of the shadow mask. Accordingly, referring to FIGS. 7A–7D, the U.S. Pat. No. 4,827,179 discloses addition of a damper to the dynamic vibration absorber for overcoming a problem of mis-tuning. However, the first order natural frequency of the shadow mask varies with the screen temperature more than 100 Hz, it is difficult for the multiple vibration absorber to cover such a great variation of the frequency.

In the meantime, the U.S. Pat. No. 4,827,179 discloses tuning the natural frequency by using change of a length of cantilever, fitting the tuned cantilevers to a rigid bracket which is in turn fitted to a non-effective surface of the shadow mask. However, the foregoing method has the following problem.

The individual fitting of the plurality of cantilevers to the bracket in the U.S. Pat. No. 4,827,179 requires much time, causing difficulty in fabrication. Moreover, the rigid bracket between the shadow mask and the cantilever impedes a smooth transmission of a vibration energy, that makes the vibration attenuation effect poor.

Moreover, referring to FIGS. 7A and 7D, the U.S. Pat. No. 4,827,179 discloses the means for supplementing a damping capability by friction or collision, i.e., a damper, provided as a separate member, that is not suitable for mass production because of a high production cost, and defects in an impact test of the CRT.

SUMMARY OF THE INVENTION

Accordingly, the present invention is directed to a dynamic vibration absorber in a cathode ray tube that substantially obviates one or more of the problems due to limitations and disadvantages of the related art.

An object of the present invention is to provide a dynamic vibration absorber in a cathode ray tube, which can absorb a vibration occurred at a shadow mask effectively.

An object of the present invention is to provide a dynamic vibration absorber in a cathode ray tube, which permits easy fabrication and mass production.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the dynamic vibration absorber in a CRT having a shadow mask fastened to an inside surface of a panel by main frames, includes a base part to be fitted to a non-effective surface of the shadow mask, and a vibration absorbing part having one end connected to the base part and the other end designed to make no contact with the shadow mask and the main frame. It is preferable that the base part and the vibration absorbing part are formed as one unit.

The vibration absorbing part preferably includes a connecting part connected to the base part, and a vibrating part extended from, and bent at an angle from the connecting part. Preferably, the vibrating part is bent in a direction of the main frame, and the connecting part is bent to a direction opposite to the main frame at an angle.

In the meantime, the vibration absorbing part includes a plurality of vibration absorber pieces each having a natural frequency substantially identical to a natural frequency of a point of the shadow mask the vibration absorber piece is in contact. Preferably, the natural frequency of the vibration absorber piece has less than approx. 10% difference from the natural frequency of the shadow mask.

The vibrating part has a gap to a side surface of the main frame less than a vibration amplitude of the vibrating part such that the vibrating part collides onto the main frame when the vibrating part vibrates.

The vibrating part is bent toward a direction of the side surface of the main frame at an angle.

The vibrating part is bent toward a direction of the side surface of the main frame at an angle such that an end of the vibrating part is always in contact with the side surface of the main frame.

Preferably, the vibrating part has a part a little away from the end thereof bent toward the direction of the side surface of the main frame at an angle to form a length of a contact part at the end part of the vibrating part.

Thus, the dynamic vibration absorber in a cathode ray tube of the present invention can absorb the vibration occurred at the shadow mask, and reduces a production cost as fabrication and mass production is easy.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
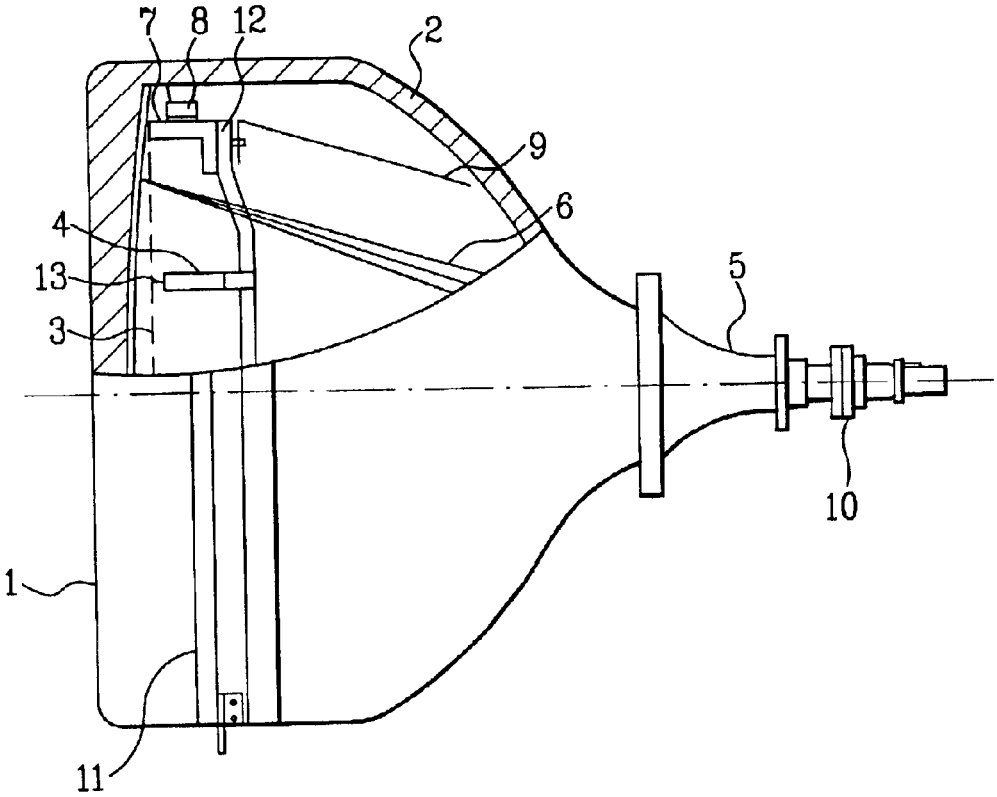
FIG.1 Related Art
FIG. 1 illustrates a side view of a related art color CRT, with a partial cut away view.
Figure 2:
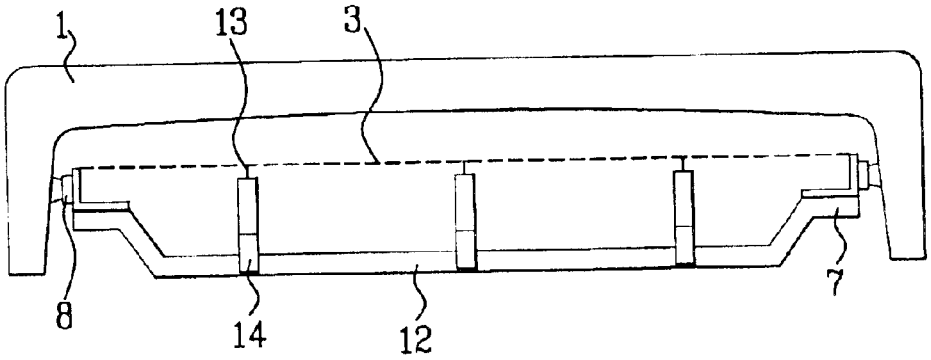
FIG.2 Related Art
FIG. 2 illustrates a section showing the shadow mask in FIG. 1 assembled to a panel, schematically.
Figure 3:
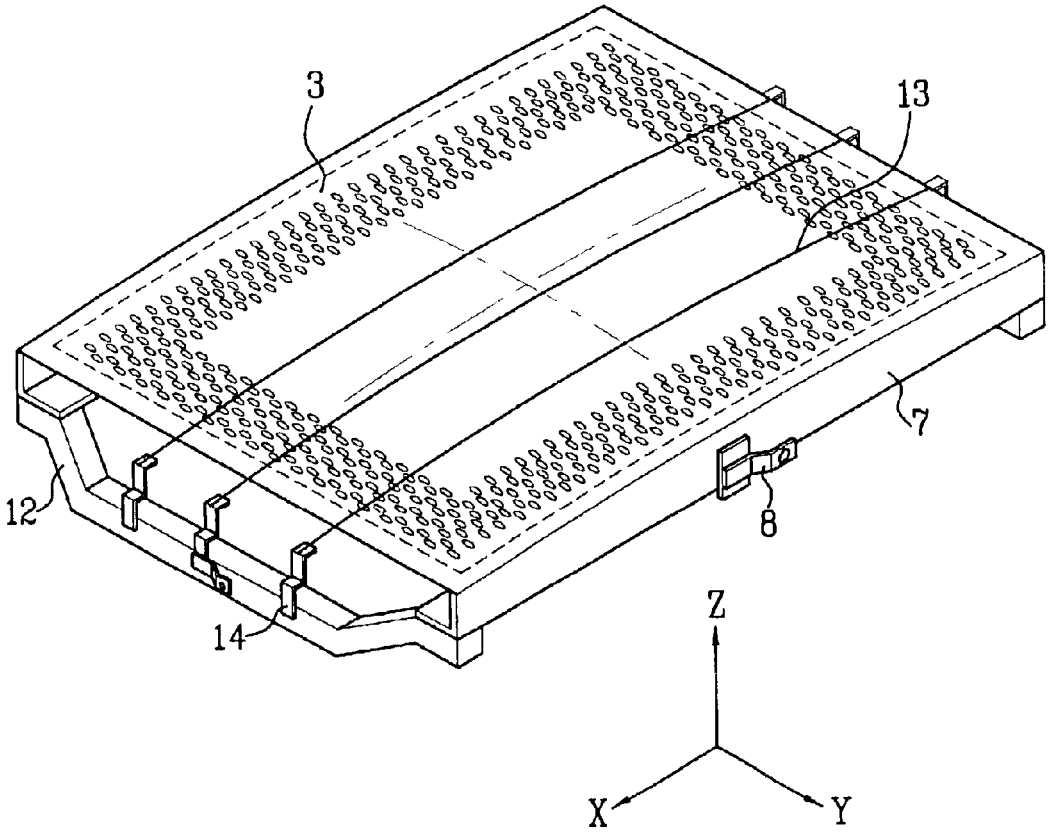
FIG. 3 Related Art
FIG. 3 illustrates a perspective view of the shadow mask assembly in FIG. 1.
Figure 4:
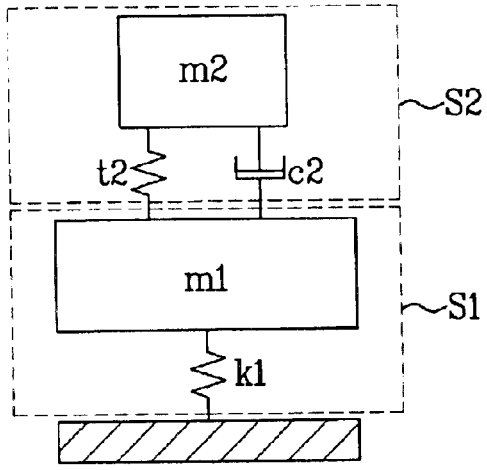
FIG. 4 Related Art
FIG. 4 illustrates a dynamic vibration absorber applied to a system of one degree of freedom, schematically.
Figure 5:
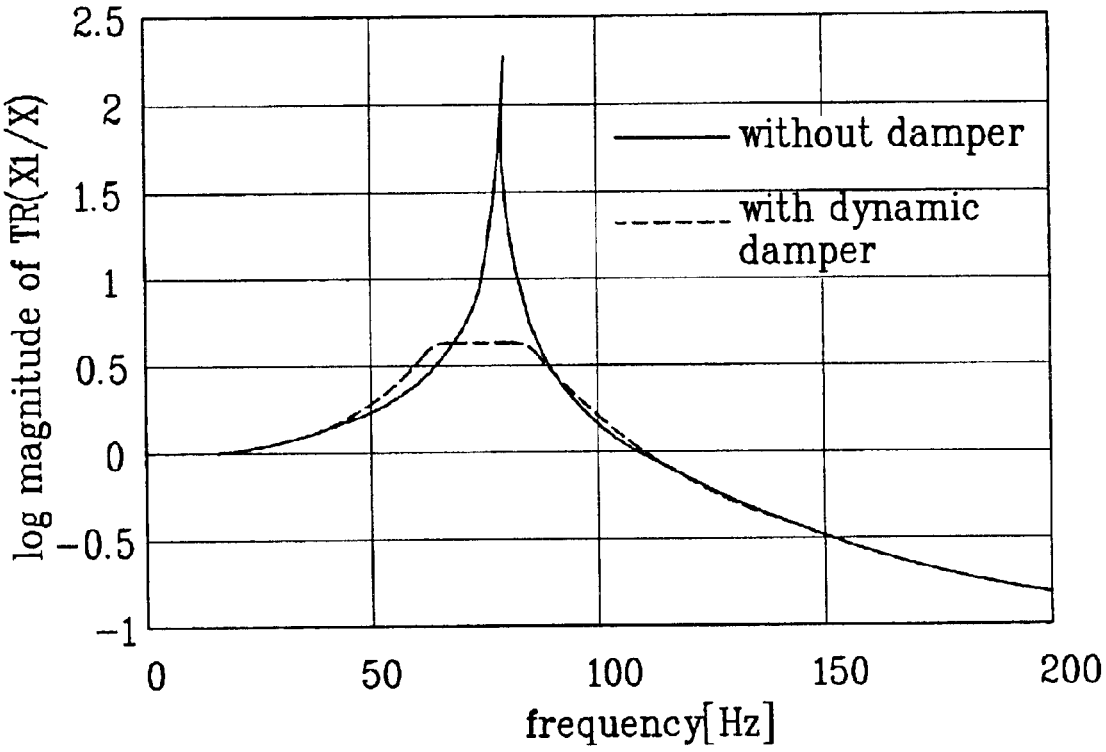
FIG.5 Related Art
FIG. 5 illustrates a graph showing vibrations with and without a dynamic vibration absorber.
Figure 6:
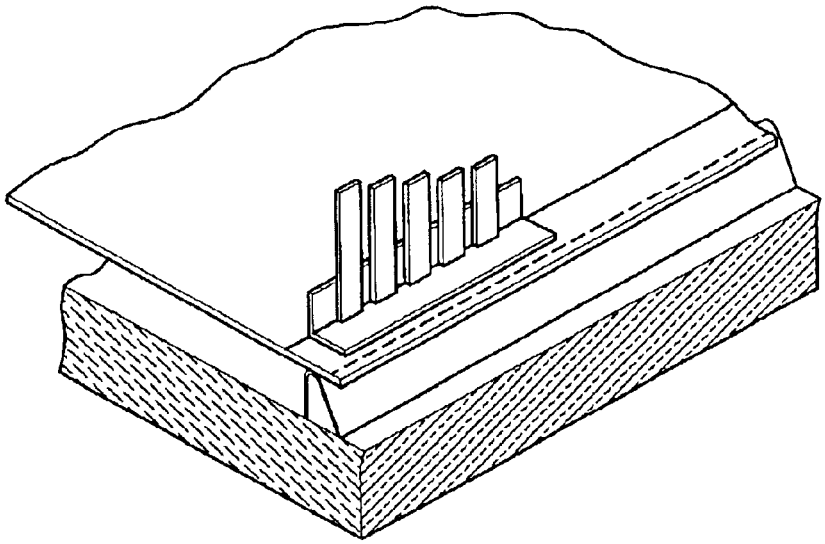
FIG. 6 Related Art
FIG. 6 illustrates a perspective view of related art multiple dynamic vibration absorber.
Figure 7A:
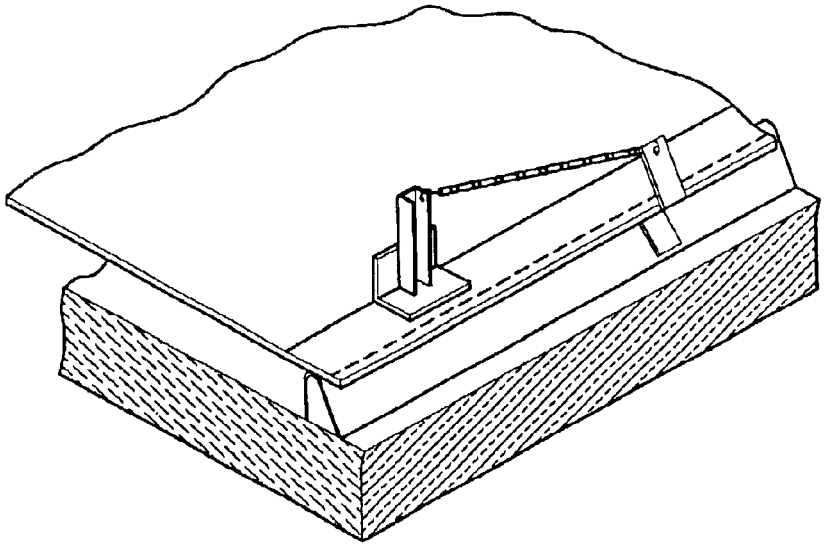
FIG. 7A Related Art
FIGS. 7A–7D illustrate perspective views each showing a related art dynamic vibration absorber with a damper.
Figure 7B:
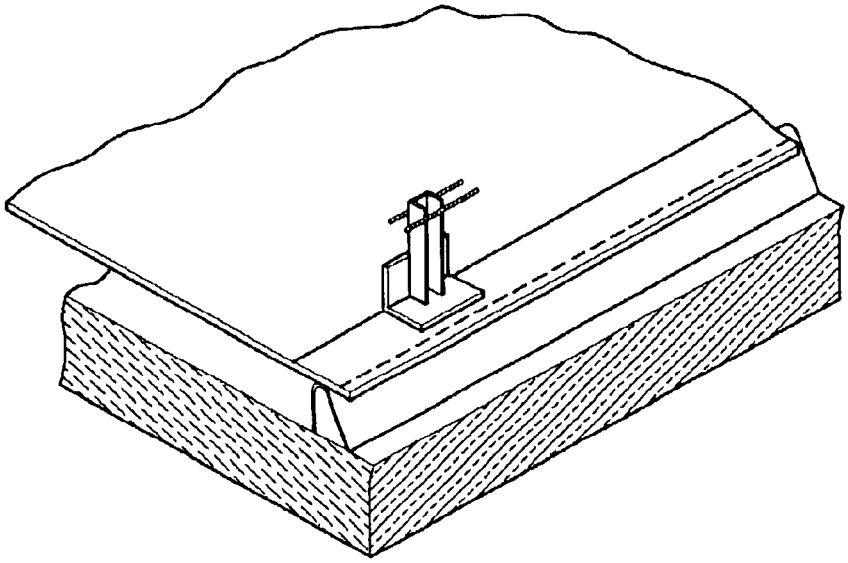
FIG. 7B Related Art
Figure 7C:
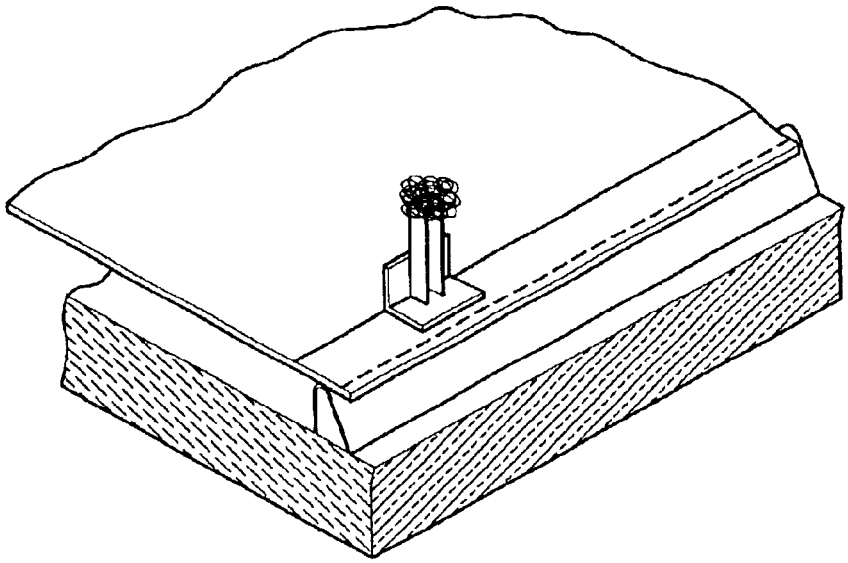
FIG. 7C Related Art
Figure 7D:
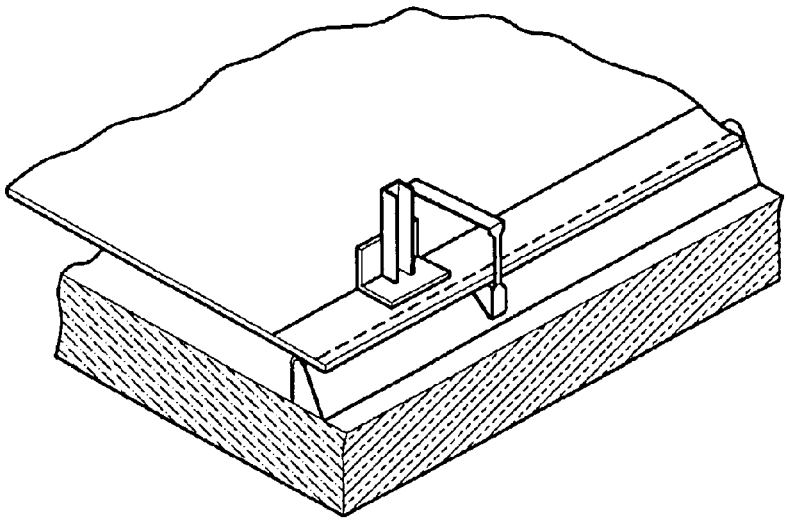
FIG. 7D Related Art
Figure 8:
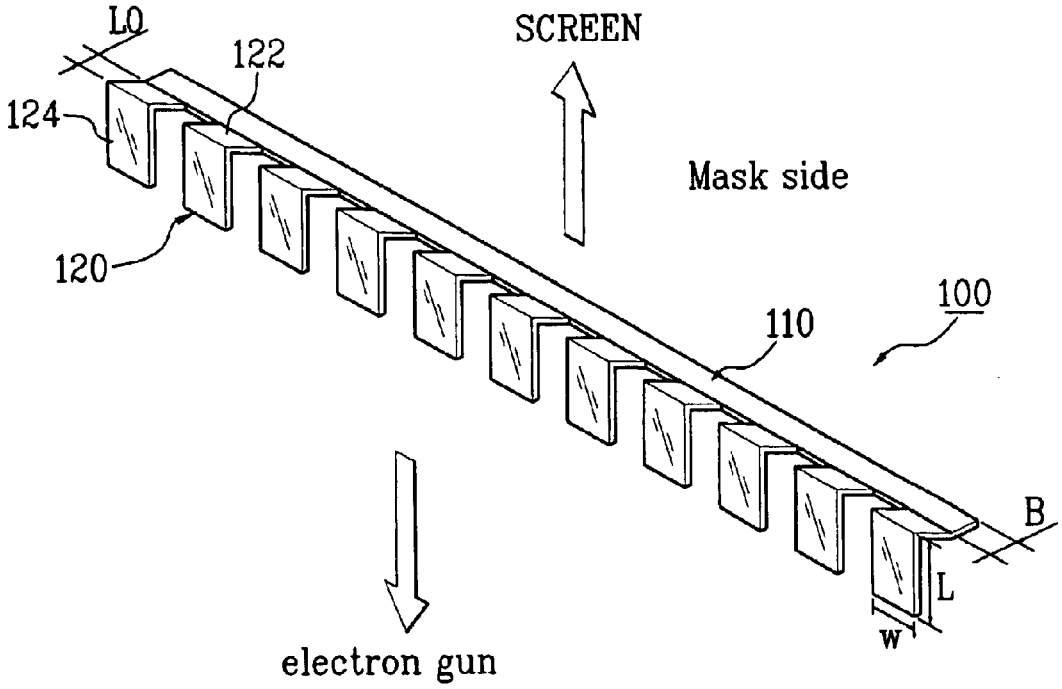
FIG. 8 illustrates a perspective view of a dynamic vibration absorber in a CRT in accordance with a preferred embodiment of the present invention.

Reference will now be made in detail to the preferred embodiments of the present invention, examples of which are illustrated in the accompanying drawings. The dynamic vibration absorber in a CRT of the present invention will be explained with reference to FIGS. 8–10.

The dynamic vibration absorber 100 in a CRT of the present invention includes a base part 110 and a vibration absorbing part 120. The base part 110 receives a vibration of the shadow mask 3, and the vibration absorbing part 120 is connected to the base part 110, and tuned to natural frequencies of the shadow mask 3 for actual absorption of the vibration. It is preferable that the base part 110 and the vibration absorbing part 120 are formed as one unit by pressing or sheet metal working. Also, it is preferable that the base part 110 and the vibration absorbing part 120 are formed of the same material.

The base part 110 and the vibration absorbing part 120 will be explained, in detail.

It is preferable that the base part 110 is fixed to a non-effective surface of the shadow mask 3. Accordingly, a width 'B' of the base part 110 is fixed by a width of the non-effective surface of the shadow mask.

The vibration absorbing part 120 includes a plurality of vibration absorber pieces of cantilevers. That is, the vibration absorber piece 120 is connected substantially parallel to the base part 110 and includes a connecting part 122, and a vibrating part 124 connected to, and bent at an angle from the connecting part 122. The vibrating part 124 receives the vibration of the shadow mask 3 to absorb the vibration of the shadow mask 3 as the vibrating part 124 vibrates freely.

It is preferable that the vibrating part 124 is bent in a main frame direction, i.e., an electron gun direction, more preferably along a side surface of the main frame 7 substantially parallel to the main frame 7.

Preferably, the vibration absorbing part 120 includes a plurality of vibration absorber pieces. Each of the vibration absorber pieces preferably has a form, i.e., a length L, and L0 and a width W determined such that the natural frequency of the vibration absorber piece is substantially identical to a point of the natural frequency of the shadow mask the vibration absorber piece is fitted thereto. It is preferable that the plurality of vibration absorber pieces are spaced away from each other.

The base part 110 is welded to the shadow mask 3 such that a starting point of the vibration absorber piece 120 is not in contact with the main frame 7 in the welding. If the starting point of the vibration absorber piece 120 is on the main frame 7, the vibration of the vibration absorber piece 120 can be reduced by the main frame. Therefore, it is preferable that the starting point of the vibration absorber piece 120, i.e., the connecting part 122 is sloped upward, i.e., in a direction opposite to the main frame at an angle.

Figure 9:
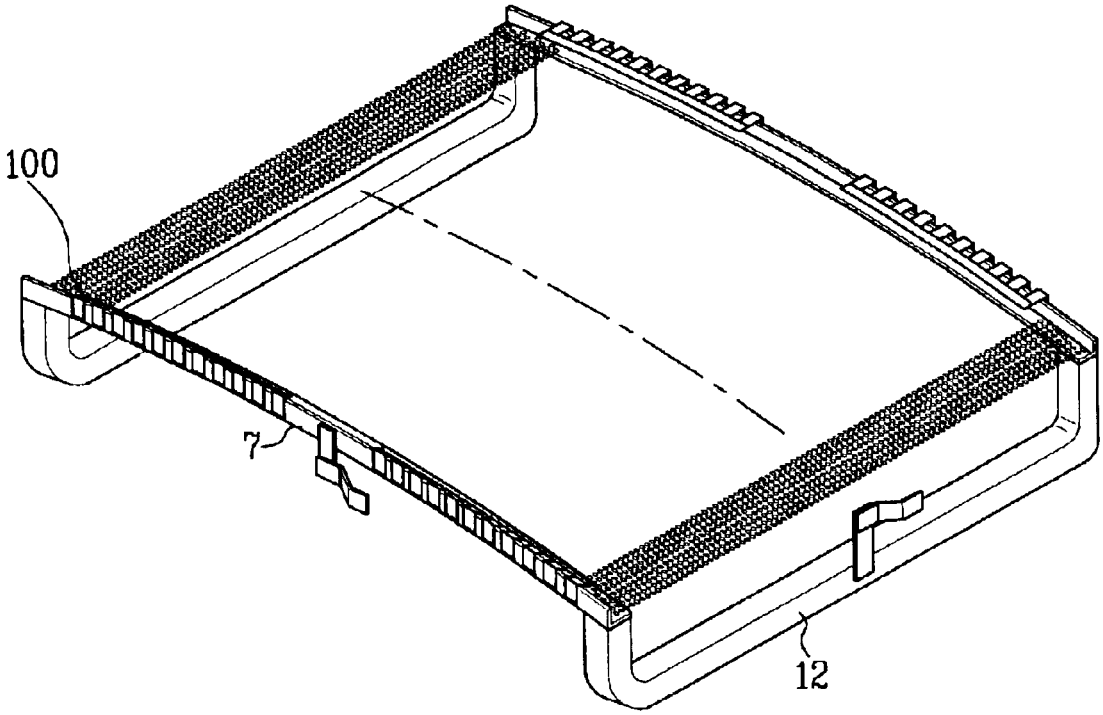
FIG. 9 illustrates a perspective view of the dynamic vibration absorber in a CRT in FIG. 8 fitted to a shadow mask.
Figure 10:
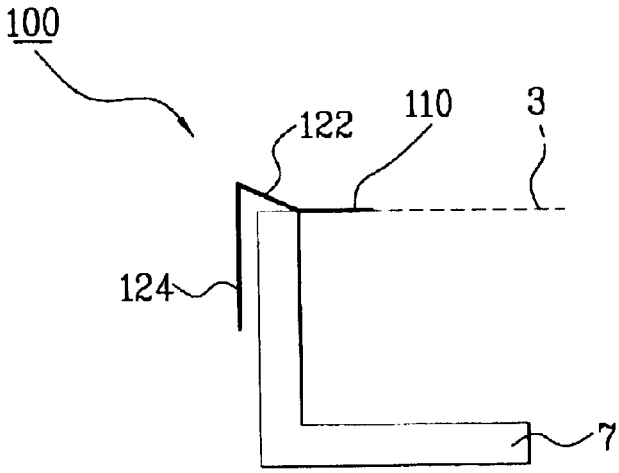
FIG. 10 illustrates a section of the dynamic vibration absorber in a CRT in FIG. 8.

In the meantime, referring to FIG. 9, the dynamic vibration absorber 100 is fitted on a horizontal axis of the shadow mask 3 intended to reduce the vibration thereof. For enhancing the vibration attenuating effect, though it is preferable that the vibration absorbers 100 are fitted both to top and bottom of the shadow mask, this case costs high and requires more working time. Therefore, it is favorable that the dynamic vibration absorber 100 is fitted only to the top or bottom of the shadow mask 3 in view of fabrication. It is also preferable that the vibration absorbing part 120 has mass approx. 10–20% of mass of the shadow mask.

Figure 11:
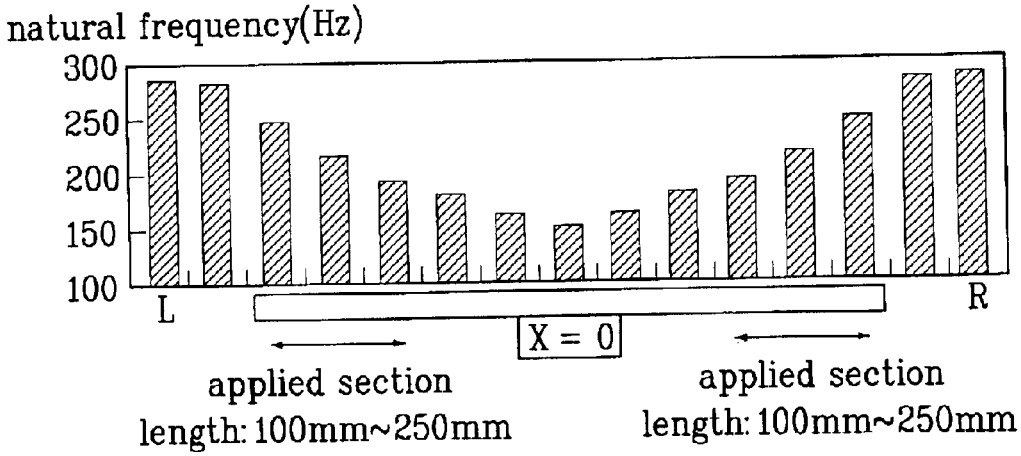
FIG. 11 illustrates a distribution of natural frequencies of a shadow mask.

A method for designing a form of a dynamic vibration absorber in a CRT of the present invention will be explained, with reference to FIGS. 11 and 12. It is preferable that the form of the dynamic vibration absorber is designed by using the finite element method.

At first, a natural frequency distribution along the horizontal axis of the shadow mask is made known. As shown in FIG. 11, the natural frequency distribution of a tension type shadow mask is a 'V' form, substantially. A form of the vibration absorbing part 120 is designed from the natural frequency distribution of the shadow mask. That is, the length L and L0 and the width W of each of the vibration absorber pieces 120 are fixed such that the natural frequency of the vibration absorber piece 120 is substantially identical to the natural frequency of the point of the shadow mask the vibration absorber piece 120 is fitted thereto. Since the width W of the vibration absorber piece 120 is little influential, the form of the vibration absorber piece 120 is designed mostly in view of the lengths L and L0 of the vibration absorber piece 120. Moreover, since a length L0 of the connecting part is smaller than a length L of the vibrating part, what is required actually is to fix the length L0 of the connecting part.

In the meantime, it is preferable that the dynamic vibration absorber is fitted throughout an entire surface of the non-effective surface of the shadow mask, for attenuating entire vibration of the shadow mask. However, taking the fabrication process and cost into account, the dynamic vibration absorber 100 may be fitted only to selected regions, for an example, regions the vibration is the most intensive.

In this embodiment of the present invention, the dynamic vibration absorber is designed for parts 100 mm–250 mm from a center x=0 of the horizontal axis of the shadow mask on both sides thereof, i.e., sections each with a length of 150 mm.

Figure 12:
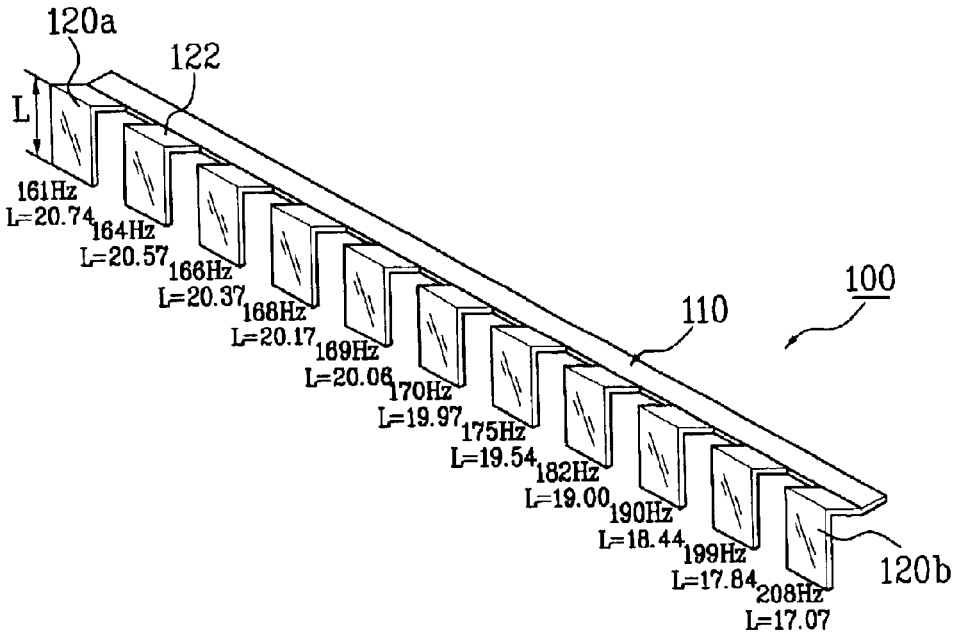
FIG. 12 illustrates a form of a dynamic vibration absorber for a distribution of natural frequencies of a shadow mask.

FIG. 12 illustrates a dynamic vibration absorber designed according to natural frequencies of the shadow mask in the sections. A first vibration absorber piece 120*a* is the vibration absorber piece fitted at 100 mm point from the center of the shadow mask, and a last vibration absorber piece 120*b* is the vibration absorber piece fitted at 250 mm point from the center of the shadow mask.

The first vibration absorber piece 120*a* has a length L 20.74 mm and a width W 10 mm designed to have a 161 Hz natural frequency, and the last vibration absorber piece 120*b* has a length L 17.07 mm and a width W 10 mm designed to have a 208 Hz natural frequency.

It is preferable that the length and width of the vibration absorber piece is designed such that the natural frequency of the vibration absorber piece has an error less than the natural frequency of the part of the shadow mask the vibration absorber piece deals with. Because there will be no effect of vibration attenuation if the error is greater than 10% due to mismatch of the vibrations.

Figure 13:
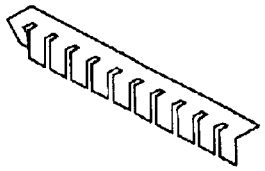
FIG. 13 illustrates vibration of the dynamic vibration absorber in a CRT in FIG. 12.
Figure 13:
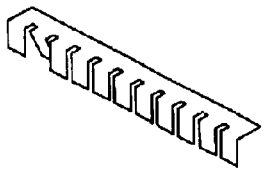
Figure 13:
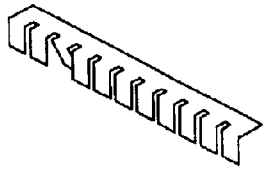
Figure 13:
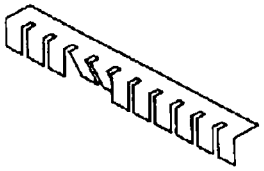
Figure 13:
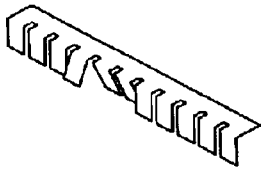
Figure 13:
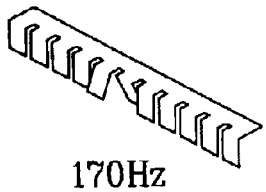
Figure 13:
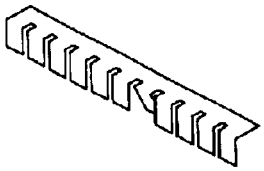
Figure 13:
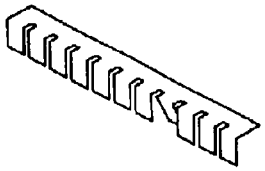
Figure 13:
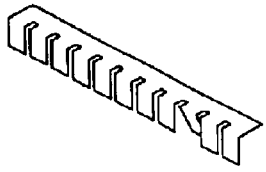
Figure 13:
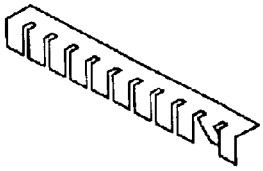
Figure 13:
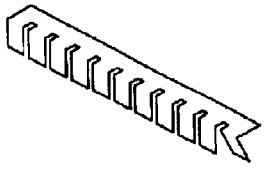

FIG. 13 illustrates a vibration mode of the dynamic vibration absorber designed as shown in FIG. 12.

Referring to FIG. 13, once a vibration of the shadow mask the same with the natural frequency of one of the vibration absorber pieces is occurred, only the relevant vibration absorber piece vibrates, to attenuate the vibration. Especially, since the vibration of the vibration absorber piece has the same frequency, but an opposite phase, to the vibration of the shadow mask, the vibration of the shadow mask can be suppressed, significantly.

A dynamic vibration absorber in a CRT in accordance with another preferred embodiment of the present invention will be explained, with reference to FIGS. 14 and 15.

This embodiment suggests to add damping means to the foregoing dynamic vibration absorber 100. Whatever well the natural frequency of the dynamic vibration absorber is tuned, a degree of the tuning may be deteriorated from a product distribution or a fabrication process, for supplementing which addition of a damper is required.

This embodiment of the present invention provides no separate damping means, but makes a simple modification of the form of the vibration absorber piece of the previous embodiment, particularly, the vibrating part 124 only, for obtaining a damping capability.

Figure 14:
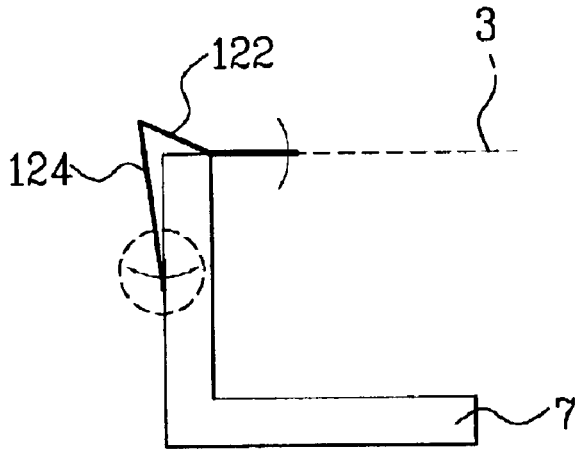
FIG. 14 illustrates a section of a dynamic vibration absorber in a CRT in accordance with another preferred embodiment of the present invention.

The dynamic vibration absorber shown in FIG. 14 provides a collision damping effect. That is, a gap between the vibrating part 124 and the main frame 7 is made smaller so that the vibrating part 124 collide onto the side surface of the main frame 7 when the vibration is occurred. That is, it is required that the gap between the vibrating part 124 and the main frame 7 is smaller than an amplitude of the vibration of the vibrating part 124 excited by the vibration of the shadow mask 7.

Though the vibrating part 124 can collide with the main frame 7 in a state the vibrating part 124 is fitted substantially parallel to the side surface of the main frame 7, it is preferable that the vibrating part 124 is bent toward the side surface of the main frame 7 at an angle.

When the vibration occurred at the shadow mask 3 is transmitted to the vibrating part 124 of the dynamic vibration absorber, the vibrating part 124 vibrates. In this instance, the gap between the vibrating part 124 and the side surface of the main frame 7 is smaller than the amplitude of the vibration, the vibrating part 124 and the main frame 13 collide.

Meanwhile, as a departure speed after the collision is slower than an approaching speed before the collision when two object collide, the vibration is reduced, to provide the damping capability.

Figure 15:
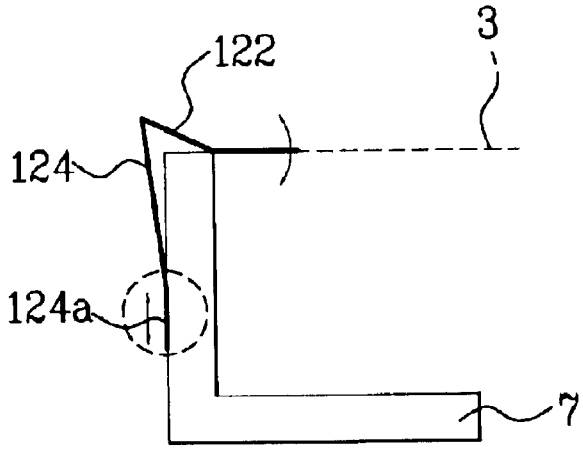
FIG. 15 illustrates a section of a dynamic vibration absorber in a CRT in accordance with another preferred embodiment of the present invention; and, FIG. 16 illustrates a block diagram of a testing apparatus for testing an effect of the dynamic vibration absorber in a CRT of the present invention.
Figure 16:
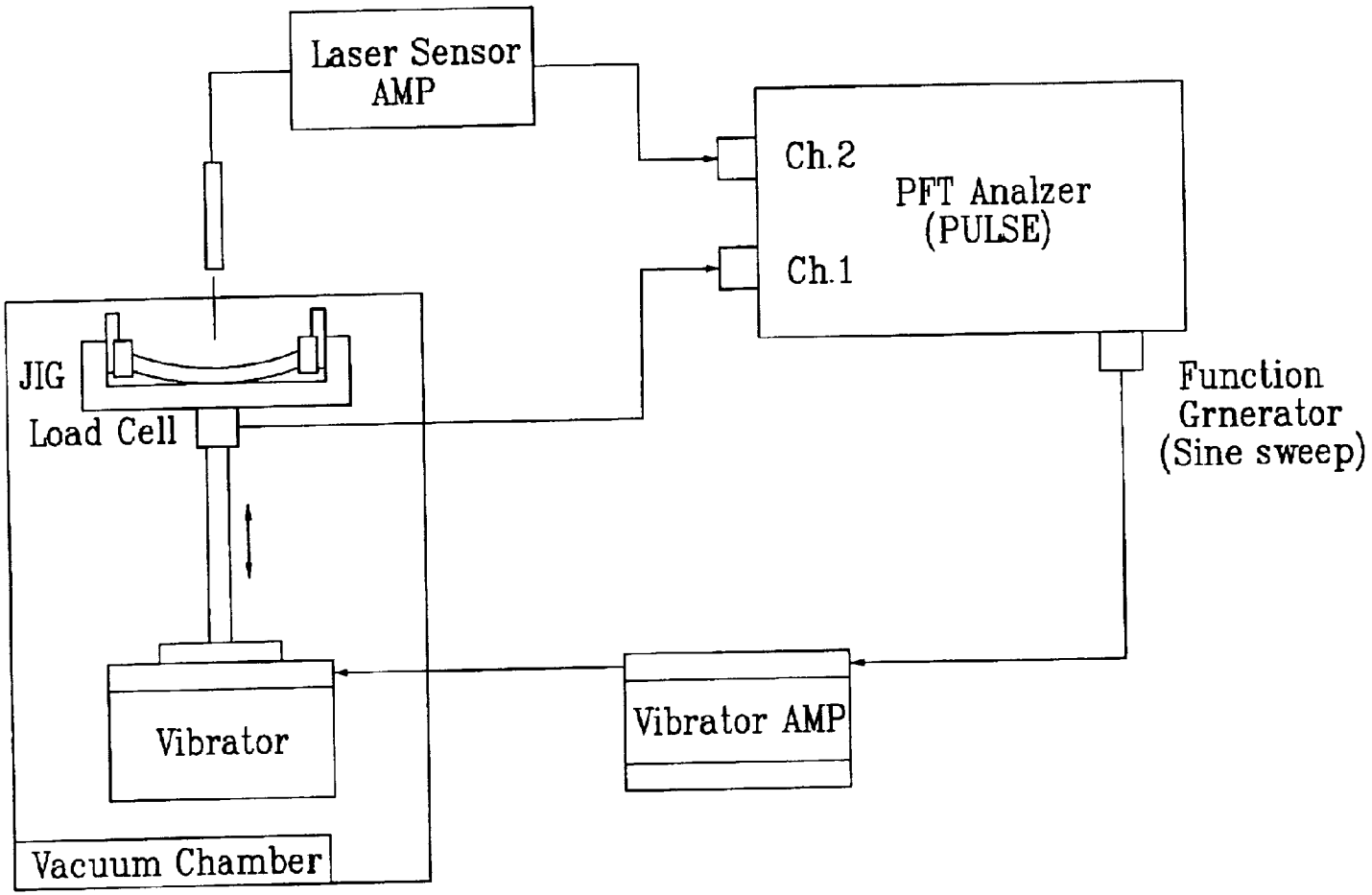

A dynamic vibration absorber in FIG. 15 provides a frictional damping effect. That is, the vibrating part 124 is bent toward the side surface of the main frame 7 at an angle such that an end of the vibrating part 124 always in contact with the side surface of the main frame 7. Though the vibrating part 124 in the previous embodiment comes into contact (collide) with the side surface of the main frame 7 only when the vibrating part 124 vibrates, in the present invention, the vibrating part 124 is always in contact with the side surface of the main frame 7.

It is preferable that a part in contact with the side surface of the main frame 7 is long. Therefore, it is preferable that a part slightly away from an end of the vibrating part 124 is bent to a side surface direction of the main frame 7 to form a contact part 124 at an end part of the vibrating part 124. Above structure provides a damping capability as the main frame 7 and the end part of the vibrating part 124 causes friction when the vibrating part 124 of the vibration absorber vibrates.

The addition of a damping capability to the dynamic vibration absorber provides an effect of correcting mistuning to a certain degree.

For verifying the effect of the present invention, a test is carried out by using a testing apparatus for evaluating a vibration. That is, the shadow mask is mounted in a vacuum chamber that is in a state the same with an inside of the CRT. Then, a vibration is applied to glass corresponding to the panel, and variation of the vibration of the shadow mask is measured from an outside of the vacuum chamber by means of a laser Doppler sensor. As an applied signal, a sinusoidal signal having a natural frequency the same with respective regions of the shadow mask is used. The following tables 1–4 show results of the tests.

TABLE 1

| 1* | 1 | 2 | 3 | 4 | 5 | 6 | 7 | 8 | 9 | 10 | 11 |
|---|---|---|---|---|---|---|---|---|---|---|---|
| 2* | 150.2 | 152.5 | 155.0 | 164.9 | 172.0 | 175.6 | 187.0 | 195.0 | 206.5 | 213.5 | 213.5 |
| 3* | 126.5 | 95.85 | 45.98 | 112.0 | 94.65 | 68.35 | 26.75 | 25.68 | 42.73 | 30.75 | 36.15 |

1*: Points,

2*: Natural frequency (Hz), and

3*: Vibration frequency (Hz).

TABLE 2

| 1* | 1 | 2 | 3 | 4 | 5 | 6 | 7 | 8 | 9 | 10 | 11 |
|---|---|---|---|---|---|---|---|---|---|---|---|
| 2* | 150.1 | 152.5 | 155.1 | 164.6 | 171.9 | 175.6 | 187.0 | 195.0 | 206.5 | 213.4 | 213.4 |
| 3* | 101.0 | 61.00 | 31.90 | 51.35 | 54.60 | 89.90 | 26.05 | 22.10 | 35.40 | 19.55 | 29.40 |
| 4* | 20.2 | 36.4 | 30.6 | 54.2 | 42.3 | 31.5 | 2.6 | 13.9 | 19.5 | 36.4 | 18.7 |
| 5* | | | | | | 22.1% | | | | | |

1*: Points,
2*: Natural frequency (Hz),
3*: Vibration frequency (Hz).
4*: Attenuation ratio %, and
5*: Average attenuation ratio

TABLE 3

| 1* | 1 | 2 | 3 | 4 | 5 | 6 | 7 | 8 | 9 | 10 | 11 |
|---|---|---|---|---|---|---|---|---|---|---|---|
| 2* | 150.2 | 152.5 | 155.0 | 164.9 | 172.0 | 175.6 | 187.0 | 195.0 | 206.5 | 213.5 | 213.5 |
| 3* | 89.45 | 75.95 | 26.30 | 68.75 | 46.65 | 41.90 | 16.60 | 11.35 | 36.15 | 25.25 | 32.45 |
| 4* | 29.3 | 20.8 | 42.8 | 38.6 | 50.7 | 38.7 | 37.9 | 55.8 | 15.4 | 17.9 | 10.2 |
| 5* | | | | | | 32.6% | | | | | |

1*: Points,
2*: Natural frequency (Hz),
3*: Vibration frequency (Hz).
4*: Attenuation ratio %, and
5*: Average attenuation ratio

TABLE 4

| | | | | | | | | | | | |
|---|---|---|---|---|---|---|---|---|---|---|---|
| 1* | 1 | 2 | 3 | 4 | 5 | 6 | 7 | 8 | 9 | 10 | 11 |
| 2* | 150.2 | 152.5 | 155.0 | 164.9 | 172.0 | 175.6 | 187.0 | 195.0 | 206.5 | 213.5 | 213.5 |
| 3* | 91.15 | 24.90 | 18.35 | 89.65 | 54.15 | 42.50 | 19.95 | 15.65 | 22.85 | 15.85 | 22.35 |
| 4* | 27.9 | 74.0 | 60.1 | 20.0 | 42.8 | 37.8 | 25.4 | 39.0 | 46.5 | 48.5 | 38.2 |
| 5* | | | | | | 41.8% | | | | | |

1*: Points,
2*: Natural frequency (Hz),
3*: Vibration frequency (Hz).
4*: Attenuation ratio %, and
5*: Average attenuation ratio In each of the tables, the point 1 is near to the center of the shadow mask, and the point 11 is near to an end of the shadow mask.

Table 1 shows natural frequencies and vibration of different points of the shadow mask without the vibration absorber, and table 2 shows natural frequencies and vibration of different points of the shadow mask with the dynamic vibration absorber without damper added thereto. It can be noted from tables 1 and 2 that the dynamic vibration absorber in a CRT of the present invention provides approx. 22% of vibration attenuation effect. However, in the case of table 2, the vibration attenuation ratios vary with points substantially.

Table 3 shows natural frequencies and vibration of different points of the shadow mask with the dynamic vibration absorber with a frictional damper added thereto. The dynamic vibration absorber with the frictional damper has approx. 33% of average vibration attenuation ratio, from which it can be noted that the dynamic vibration absorber with the frictional damper has an average vibration attenuation ratio 11% less than the dynamic vibration absorber without the damper.

Table 4 shows natural frequencies and vibration of different points of the shadow mask with the dynamic vibration absorber with a collision damper added thereto. The dynamic vibration absorber with the collision damper has approx. 42% of average vibration attenuation ratio. Thus, the addition of frictional and collision dampers permits a high vibration attenuation effect on the whole.

In the meantime, the foregoing embodiments show and explain addition of only a frictional damper or a collision damper to the dynamic vibration absorber. However, the present invention is not limited thereto, and an appropriate combination of the frictional damper and the collision damper depending on points of the shadow mask is also possible.

As has been explained, the dynamic vibration absorber in a cathode ray tube of the present invention has the following advantages.

First, the application of the dynamic vibration absorber of the present invention to the shadow mask that has a natural frequency which shows no variation with temperatures permits an effective attenuation of the vibration at different points of the shadow mask.

Second, the dynamic vibration absorber in a cathode ray tube of the present invention permits an easy modification of the form of the vibration absorber piece to added a frictional and collision damping capability thereto, that further enhance the vibration attenuation effect of the shadow mask.

Third, different from the related art, the dynamic vibration absorber in a cathode ray tube of the present invention permits an easy modification of the form of the vibration absorber piece to added a frictional and collision damping capability thereto. The frictional and collision damping capability obtainable without addition of separate damping means permits to reduce a production cost owing to a high workability and a high mass productivity.

It will be apparent to those skilled in the art that various modifications and variations can be made in the dynamic vibration absorber in a cathode ray tube of the present invention without departing from the spirit or scope of the invention. Thus, it is intended that the present invention cover the modifications and variations of this invention provided they come within the scope of the appended claims and their equivalents.

What is claimed is:

1. A dynamic vibration absorber in a cathode ray tube (CRT) having a shadow mask fastened to an inside surface of a panel by main frames, comprising:

a base part to be fitted to a non-effective surface of the shadow mask; and a vibration absorbing part having one end connected to the base part and the other end designed to make no contact with the shadow mask and the main frame, wherein the base part and the vibration absorbing part are formed as one unit.

2. A dynamic vibration absorber in a cathode ray tube (CRT) having a shadow mask fastened to an inside surface of a panel by main frames, comprising:

a base part to be fitted to a non-effective surface of the shadow mask; and a vibration absorbing part having one end connected to the base part and the other end designed to make no contact with the shadow mask and the main frame, wherein the vibration absorbing part includes:

a connecting part connected to the base part, and a vibrating part extended from, and bent at an angle from the connecting part.

3. The dynamic vibration absorber as claimed in claim 2, wherein the vibrating part is bent in a direction of the main frame.

4. The dynamic vibration absorber as claimed in claim 3, wherein the connecting part is bent to a direction opposite to the main frame at an angle.

5. The dynamic vibration absorber as claimed in claim 2, wherein the vibration absorbing part includes a plurality of vibration absorber pieces each having a natural frequency substantially identical to a natural frequency of a point of the shadow mask the vibration absorber piece is in contact.

6. The dynamic vibration absorber as claimed in claim 5, wherein the natural frequency of the vibration absorber piece has approx. less than 10% difference from the natural frequency of the shadow mask.

7. The dynamic vibration absorber as claimed in claim 3, wherein the vibrating part has a gap to a side surface of the main frame less than a vibration amplitude of the vibrating part such that the vibrating part collides onto the main frame when the vibrating part vibrates.

8. The dynamic vibration absorber as claimed in claim 7, wherein the vibrating part is bent toward a direction of the side surface of the main frame at an angle.

9. The dynamic vibration absorber as claimed in claim 3, wherein the vibrating part is bent toward a direction of the side surface of the main frame at an angle such that an end of the vibrating part is always in contact with the side surface of the main frame.

10. The dynamic vibration absorber as claimed in claim 9, wherein the vibrating part has a part a little away from the end thereof bent toward the direction of the side surface of the main frame at an angle to form a length of a contact part at the end part of the vibrating part.

11. The dynamic vibration absorber as claimed in claim 2, wherein the base part and the vibration absorbing part are formed as one unit.

* * * * *